US008235587B2

(12) United States Patent
Hiranuma et al.

(10) Patent No.: US 8,235,587 B2
(45) **Date of Patent: *Aug. 7, 2012**

(54) PORTABLE DEVICE AND PORTABLE WATCH

(75) Inventors: Haruki Hiranuma, Chiba (JP); Kazutaka Imai, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/592,433

(22) Filed: Nov. 24, 2009

(65) Prior Publication Data

US 2010/0142333 A1 Jun. 10, 2010

(30) Foreign Application Priority Data

Nov. 26, 2008 (JP) ..... 2008-300716

(51) Int. Cl.
*G04B 29/00* (2006.01)

(52) U.S. Cl. ..... 368/295; 368/306; 368/319

(58) Field of Classification Search ..... 368/294–296, 368/306–308, 319–321
See application file for complete search history.

(56) References Cited

U.S. PATENT DOCUMENTS 3,548,588 A * 12/1970 Piquerez ..... 368/294
4,420,264 A * 12/1983 Murata ..... 368/223
5,742,565 A * 4/1998 Cuinet et al. ..... 368/190
6,210,034 B1 * 4/2001 Latini ..... 368/289
6,379,037 B1 * 4/2002 Saleh et al. ..... 368/185
6,679,624 B1 * 1/2004 Mouawad ..... 368/216
6,872,899 B2 * 3/2005 Oshio et al. ..... 200/43.13
7,434,984 B2 * 10/2008 Hiranuma et al. ..... 368/295
7,494,270 B2 * 2/2009 Hiranuma et al. ..... 368/288
2004/0100869 A1 * 5/2004 Finazzi ..... 368/1
2005/0254353 A1 * 11/2005 Cogoli et al. ..... 368/281

OTHER PUBLICATIONS

Patent Abstracts of Japan, Publication No. 2003-007164, Publication Date Jan. 10, 2003.

* cited by examiner

*Primary Examiner* — Sean Kayes
(74) *Attorney, Agent, or Firm* — Adams & Wilks

(57) ABSTRACT

A portable device, such as a wristwatch, has a push-button that includes an engaging portion, and the push-button is mounted on a watch sheath. A locking member and a leaf spring are arranged on the watch sheath. The locking member is movable between a locked position in which the push-button is held at a predetermined position by engagement with the engaging portion and an unlocked position where operation of the push-button is allowed. The locking member is urged by the leaf spring toward the unlocked position. A circular operating ring surrounds an hour plate mounted on the watch sheath and the operating ring is rotatably mounted to the watch sheath from the front side. The movement of the locking member between the locked position and the unlocked position is interlocked with a rotating operation of the operating ring.

9 Claims, 10 Drawing Sheets

PORTABLE DEVICE AND PORTABLE WATCH

BACKGROUND OF THE INVENTION a) Field of the Invention

The present invention relates to a portable device and a portable watch having a configuration in which an operating member such as a push button or a winder can be restrained so as not to be moved accidentally in a push-pull direction when not in use.

b) Description of the Related Art

Portable devices such as portable watches including wristwatches and pocket watches, stop watches, mobile phones, and portable information terminals include those having a push button for moving a contact point or the like in a device sheath mounted on the device sheath. By pushing the push button, in the case of a quartz portable watch, for example, a time display can be switched from an analogue display to a digital display, or the date or the day of the week displayed in digital can be corrected.

In the related art, in the portable devices of this type, for example, in the case of a wristwatch, in order to prevent the push button from being pushed accidentally, a female screw portion formed on an inner periphery of a cylindrical locking member is screwed onto a male screw portion formed on an outer periphery of a pipe mounted on a body of the device sheath, and the locking member is provided so as to be movable between a locked position and a lock waiting position according to the change of a screwed position of these screw portions. Also, the shape of the push button inserted into the pipe is circle in front view so as not to interfere a rotating operation of the cylindrical locking member.

Since a restraining portion of the locking member is apart from a head portion of the push button penetrated through the pipe in a state in which the locking member is arranged at the lock waiting position, a pushing operation of the push button is allowed in a stroke corresponding to the distance therefrom. In contrast, since the restraining portion is in a state of coming into contact with the head portion of the push button in a state in which the locking member is arranged at the locked position, the pushing operation of the push button is restrained.

In the technology disclosed in Patent Document, JP-A-2003-7164 (Paragraph 0002 to 0006, Paragraph 0026 to 0038 FIG. 1 to FIG. 3), the locking member is formed of a cylinder having a diameter which matches the push button, and the locking member has such a small diameter as a diameter equal to or smaller than the thickness of the device sheath, for example. Therefore, the locking member can hardly be pinched from the lateral side of the device sheath, and the workability when rotating the locking member is not good. In particular, when it is implemented as a wristwatch, the locking member can hardly be operated in a state in which the wristwatch is worn on a wrist of a human body.

OBJECT AND SUMMARY OF THE INVENTION

It is an object of the present invention is to provide a portable device and a portable watch in which an operation to restrain an operating member such as a push button so as to avoid an accidental movement of the operating member when not in use and an operation to release this restraint are achieved easily.

A portable device according to the present invention includes an operating member having an engaging portion mounted on a device sheath, a locking member moved between a locked position in which the operating member is restrained at a predetermined position by the engagement with the engaging portion and an unlocked position in which an operation of the operating member is allowed, and an urging member configured to urge the locking member toward the unlocked position, the locking member and the urging member being arranged on the device sheath, and a circular operating ring surrounding a display portion mounted on the device sheath and being mounted on the device sheath from the front side thereof so as to allow a rotating operation, and is characterized in that the movement of the locking member from the locked position to the unlocked position is interlocked with the rotating operation of the operating ring.

In the present invention, the operating member represents a push button pushed along the axial direction thereof or a push-pull winder of a watch or the like which is rotated in a state of being pulled along the axial direction. In the present invention, the predetermined position represents a position in which the push button is arranged in a waiting state which allows the push button to be pushed in if the operating member is the push button, and a position in which the winder is arranged in a waiting state which allows the winder to be pulled out if the operating member is the winder. In addition, the operating member arranged at the predetermined position is in a state not in use.

In the present invention, the device sheath represents an outer case in which driving components of the portable device are stored and, if the portable device is, for example, a portable watch such as a wristwatch or a pocket watch, it represents an outer case in which driving components such as a watch movement are stored. In the present invention, the display portion is not limited to time display, but may be those on which various data are displayed as an image such as a still image or a moving image, and the display portion preferably has a circular shape, but does not necessarily have to have the circular shape.

In the present invention, the operating ring may be provided in such a manner that at least a peripheral portion thereof is exposed so as to allow a user to place his or her fingers. When the entire surface of the operating ring is exposed, it is preferable in that a display which serves as a marker of the rotating operation can be provided on the surface thereof in a larger size, and a hooked portion for the rotating operation can also be provided as needed.

In the present invention, a spring member such as a leaf spring or a coil spring can be preferably used as the urging member configured to urge the locking member, but it may be made of other elastically deformable materials other than that. Also, when the locking member is metal having a resiliency, it is also possible to cut out the locking member and rise a cut portion, and then uses the cut and risen portion as the urging member.

In the present invention, by rotating the circular operating ring rotatably mounted on the device sheath from the front side of the device sheath, the locking member urged by the urging member can be arranged at the locked position or the unlocked position in conjunction therewith. Since the locking member arranged at the locked position is able to engage with the engaging portion of the operating member, the operating member is restrained so as not to be moved from the predetermined position by this engagement, and an erroneous operation of the operating member is prevented. Since the locking member arranged at the unlocked position is released from the engaging portion of the operating member, by pushing or pulling the push button or the push-pull operating member in the axial direction in this state, the operating member can be moved from the predetermined position.

Since the operating ring surrounds the display mounted on the device sheath, it is significantly larger than the operating member, and hence the operating ring can easily be rotated by gripping the same. In addition, since the operating ring is operated from the front side of the device sheath, for example, in the implementation in the wristwatch, even though the wristwatch is worn on the wrist of the human body, the operation is rarely hindered by the wrist. Therefore, the operation to restrain the operating member such as the push button so as to avoid an accidental movement of the operating member when not in use and the operation to release this restraint are achieved easily.

A portable device according to one example of the present invention includes a device sheath having a through hole and a storage hole intersecting the through hole respectively, a display portion mounted on the device sheath, a pipe inserted into the through hole and fixed to the device sheath, an operating member having a shaft portion slidably inserted into the pipe, an operating head provided at one end of the shaft portion and inserted into the through hole, and an engaging portion formed on the operating head, a circular operating ring formed into a size surrounding the display portion, having a locking surface which can oppose the storage hole and an unlocking recess opening on the locking surface and being rotatably mounted on the device sheath from the front side of the sheath, and a locking member having an insertion portion where the operating head is to be inserted and a stopper portion which allows engagement of the engaging portion, and being stored in the storage hole so as to be movable between a locked position where the engaging portion is engaged with the stopper portion and an unlocked position where the stopper portion is positioned apart from the engaging portion, and an urging member arranged in the storage hole and urging the locking member toward the operating ring.

In the present invention, the operating head of the operating member such as a push button may be integral with the shaft portion or may be formed separately and connected to the shaft portion.

In the present invention, by rotating the circular operating ring rotatably mounted on the device sheath from the front side of the device sheath, the locking member urged toward the operating ring by the urging member can be arranged at the locked position or the unlocked position in conjunction therewith.

In other words, in a state in which the locking surface of the rotated operating ring comes into contact with the locking member, the locking member is arranged at the locked position against the urging force of the urging member. Since the stopper portion of the locking member arranged at the locked position is able to engage with the engaging portion of the operating member, the operating member is restrained so as not to be moved from the predetermined position by this engagement, and the erroneous operation of the operating member is prevented. Also, in a state in which the locking surface of the rotated operating ring is released from the locking member and the unlocking recess opposes the locking member, the locking member enters the unlocking recess by the urging force of the urging member and is arranged at the unlocked position. Accordingly, since the stopper portion of the locking member is released from the engaging portion of the operating member, by operating the operating member inserted into the insertion portion of the locking member in the axial direction in this state, the operating member can be moved from a predetermined position.

Since the operating ring surrounds the display mounted on the device sheath, it is significantly larger than the operating member. Therefore, the operating ring can easily be rotated by gripping the same. In addition, since the operating ring is operated from the front side of the device sheath, for example, in the implementation in the wristwatch, even though the wristwatch is worn on the wrist of the human body, the operation is rarely hindered by the wrist. Therefore, the operation to restrain the operating member such as the push button so as to avoid an accidental movement of the operating member when not in use and the operation to release this restraint are achieved easily.

A preferred mode of the portable device according to the present invention is characterized in that the operating member is a push button, and a pushing operation of the push button is prevented by the locking member arranged at the locked position.

In this configuration of the present invention, there is provided a portable device in which the operation to restrain the push button so as to avoid the accidental movement of the push button when not in use and the operation to release this restraint are achieved easily. Furthermore, since the push button is arranged at a position separate from the operating ring and hence does not constrain the rotation of the operating ring, preferably, the shape of the push button in front view is not limited to a circular shape, and the shape in front view may be an arbitrary shape including non-circular shapes according to the design of the portable device.

A preferable mode of the portable device according to the present invention is characterized in that the shape of the operating head of the push button in front view is a non-circular shape.

In this configuration of the present invention, there is provided a portable device in which even though the shape of the operating head of the push button in front view is a non-circular shape, the push button can be restrained so as not to be operated accidentally when not in use.

A preferable mode of the portable device according to the present invention is characterized in that a click-stop mechanism which holds the operating ring temporarily in a state in which the locking member is arranged in the locked position.

In this configuration of the present invention, in a state in which the locking member is arranged at the locked position in association with the rotating operation of the operating ring, the operating ring can be held temporarily by a click-stop operation of the click-stop mechanism. In addition, it is preferable in that a user is notified that the locking member is placed at the locked position by the feeling of detent provided by the click-stop action and the sounds generated in association with the detent.

The portable watch according to the present invention is characterized by being configured with the portable devices according to the respective inventions.

Since the portable watch according to the present invention is configured with the portable devices in the respective inventions, the operation to restrain the push button so as not to be operated accidentally when not in use and the operation to release this restraint are achieved easily.

A preferred mode of the portable device according to the present invention is a portable watch configured with the portable devices of the respective inventions, and is characterized in that a winder of the portable watch is the push-pull operating member, and a pulling operation of the winder is prevented by the locking member arranged at the locked position.

In this configuration of the present invention, since the operating ring surrounds the display mounted on the device sheath, it is significantly larger than the winder. Therefore, the operating ring can easily be rotated by gripping the same. In addition, since the operating ring is operated from the front side of the device sheath, even though the wristwatch is worn on the wrist of the human body, the operation is rarely hindered by the wrist. Therefore, the operation to restrain the winder from being pulled out accidentally when not in use and the operation to release this restraint are easily achieved.

According to the present invention, the portable device and the portable watch in which an operation to restrain a push-pull operating member such as a push button from being moved accidentally when not in use and an operation to release this restraint are achieved easily are provided.

DESCRIPTION OF THE PREFERRED EMBODIMENTS

Referring now to FIG. 1 to FIG. 8, a first embodiment of the present invention will be described.

Figure 1:
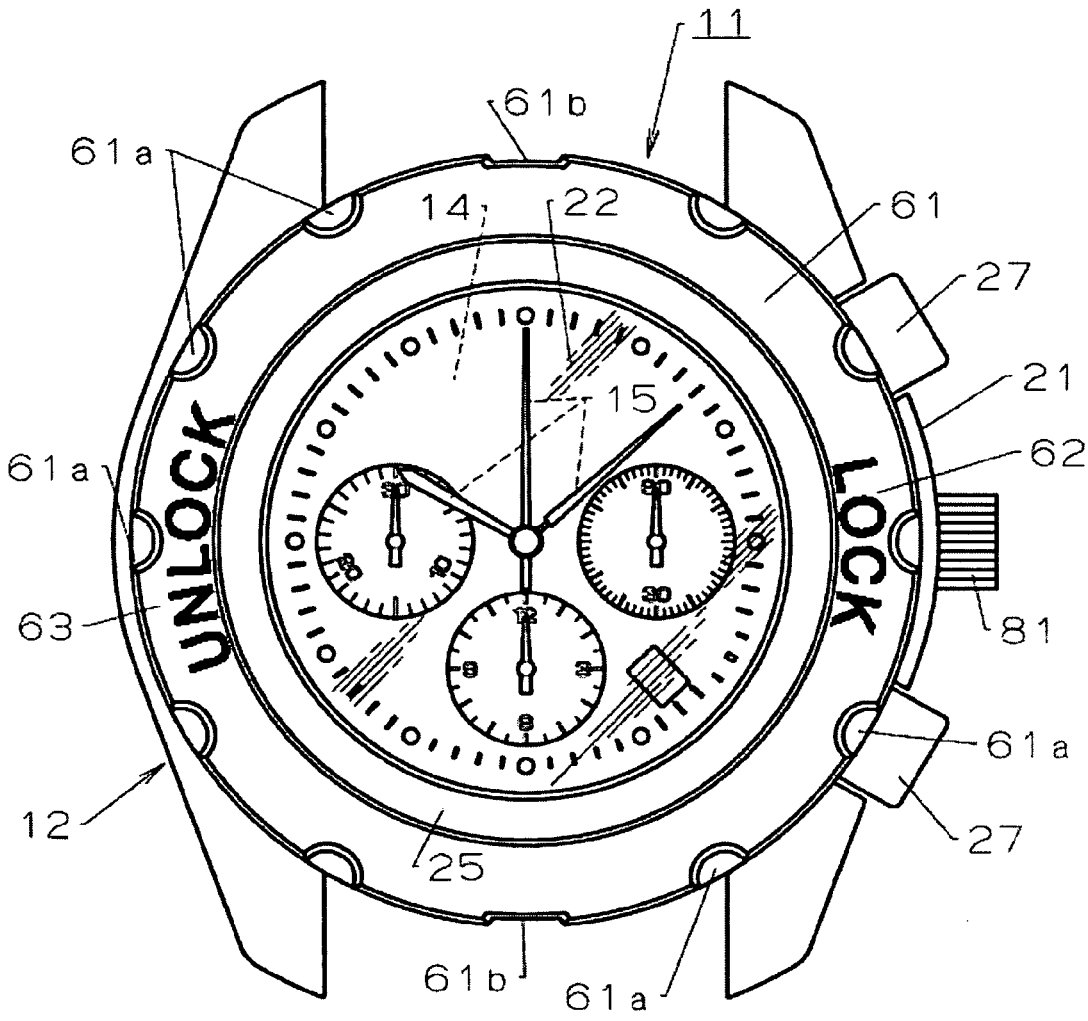
FIG. 1 is a front view showing a wristwatch according to a first embodiment of the present invention.
Figure 2:
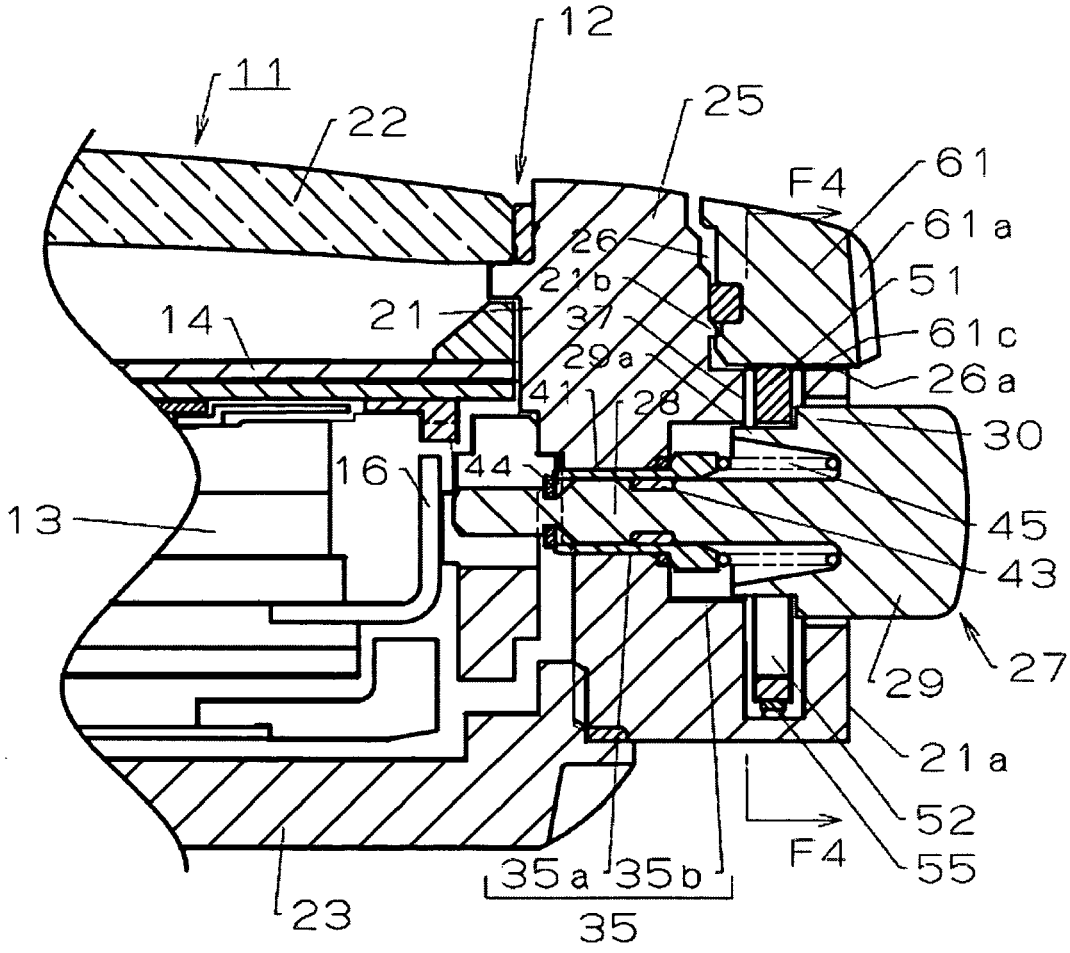
FIG. 2 is a cross-sectional view of a mounting portion of a push button of the wristwatch in FIG. 1 in a state in which the push button is locked.
Figure 3:
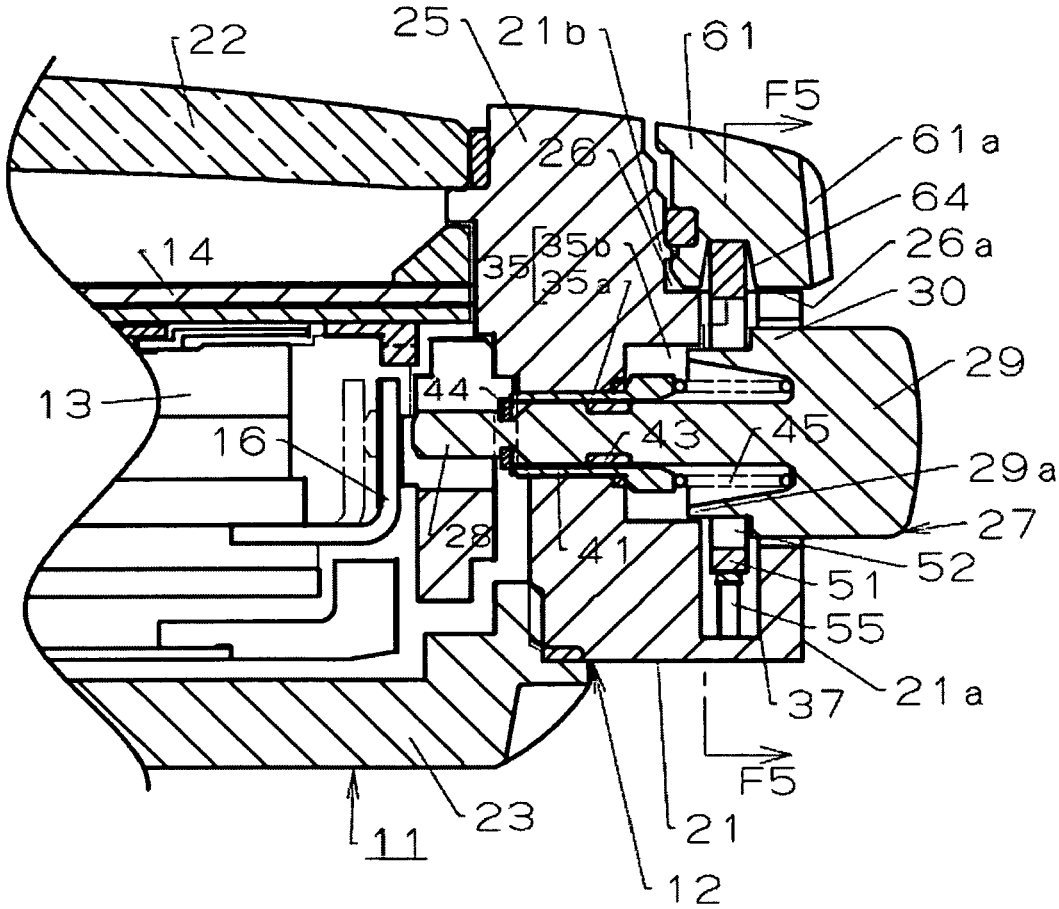
FIG. 3 is a cross-sectional view of the mounting portion of the push button of the wristwatch in FIG. 1 in a state in which the push button is unlocked.

Reference numeral 11 in FIG. 1 to FIG. 3 designates a portable device, for example, a portable watch, and more specifically, a wristwatch. A watch sheath (case) 12 of the wristwatch 11, which constitutes a device sheath or case, includes a built-in component, for example, a watch movement 13 integrated therein, and a display portion, for example, a circular hour plate 14 is mounted thereon. The display of the hour plate 14 is indicated by time display hands 15 such as an hour hand, a minute hand, and a second hand driven by the watch movement 13.

The watch movement 13 includes a contact point 16 (see FIG. 2 and FIG. 3) formed of a leaf spring or the like. When the contact point 16 is pressed by a push button, described later, the function of the watch movement 13 is changed over.

The watch sheath 12 is formed by mounting a glass 22 for allowing a viewer to see the hour plate 14 therethrough on a surface of a body 21 which constitutes a sheath body formed of a metal such as stainless steel or titanium into an annular shape on one side in terms of the thickness direction in a liquid-tight manner, and mounting a back lid 23 formed of a metal or a synthetic resin on a surface of the body 21 on the other side in terms of the thickness direction in a watertight manner.

As shown in FIG. 2 and FIG. 3, the body 21 includes an annular projection 25 and a ring arrangement groove 26 on a front portion (upper surface portion) thereof. The annular projection 25 has a circular shape, and the glass 22 is mounted on an inner peripheral surface thereof. The ring arrangement groove 26 is provided so as to surround the annular projection 25, and is opened upward and sideward of the body 21. A bottom surface 26*a* of the ring arrangement groove 26 is formed into a horizontal plane.

The body 21 is provided with a push-pull operating member, for example, a winder 81 (see FIG. 1 and FIG. 6) mounted thereon, and other operating members, for example, push buttons 27 mounted thereon. The push buttons 27 are provided, for example, at positions shifted from the winder 81 toward 12 o'clock side, and 6 o'clock side, respectively. Since the configurations of the push buttons 27 and mounting configurations to the body 21 are the same, one of them will be described below referring to FIG. 2, FIG. 3, and so on.

The body 21 is formed with a through hole 35 penetrated through the body 21 in the radial direction at a position shifted from the annular projection 25 and the ring arrangement groove 26 toward a back side of the body 21. The through hole 35 includes a pipe mounting hole 35*a* and a head insertion hole 35*b* continued therefrom.

The pipe mounting hole 35*a* is a circular hole and is opened at one end thereof to an interior of the body 21, that is, to the interior of the watch sheath 12. The other end of the pipe mounting hole 35*a* is opened to the head insertion hole 35*b*. The head insertion hole 35*b* has a diameter larger than that of the pipe mounting hole 35*a*, and is, for example, a square hole. The head insertion hole 35*b* opens to an outer surface 21*a* of the body (outer surface of the sheath).

Figure 6:
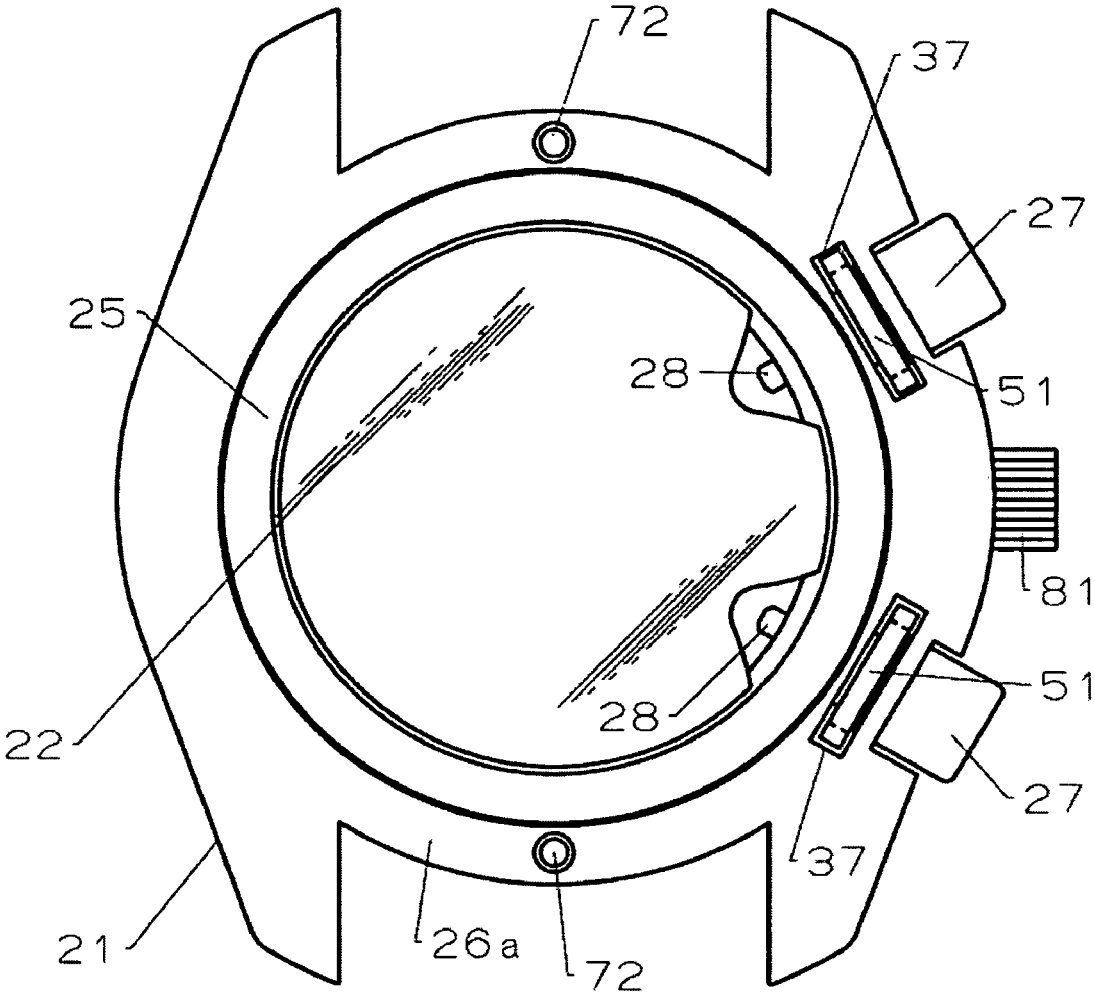
FIG. 6 is a front view, partly broken, of the wristwatch in FIG. 1 in a state in which an operating ring is removed.

The body 21 is formed with storage holes 37. The storage hole 37 is formed so as to intersect, for example so as to extend orthogonally to the head insertion hole 35*b*. As shown in FIG. 6, the storage holes 37 are formed into narrow square holes. One end (lower end) of the each storage hole 37 is closed, and the other end (upper end) of the storage hole 37 is opened. In other words, as shown in FIG. 6 and so on, the upper end of storage hole 37 is opened on the bottom surface 26*a* of the ring arrangement groove 26.

A pipe 41 having a circular cross section in the direction orthogonal to an axial direction is fixed to the body 21. The pipe 41 is formed of a metal, more preferably, of a stainless steel or the like. The pipe 41 is formed with a shoulder having a small-diameter portion and a large-diameter portion.

The pipe 41 is fixed to the body 21 by press-fitting the small-diameter portion thereof from the head insertion hole 35*b* side into the pipe mounting hole 35*a* of the through hole 35. This fixation is achieved by brazing joint using a metallic brazing material. The brazing material achieves a water-proof function between the pipe 41 and the body 21. The large-diameter portion of the pipe 41 fixed to the body 21 in this manner projects into the head insertion hole 35*b*.

Figure 4:
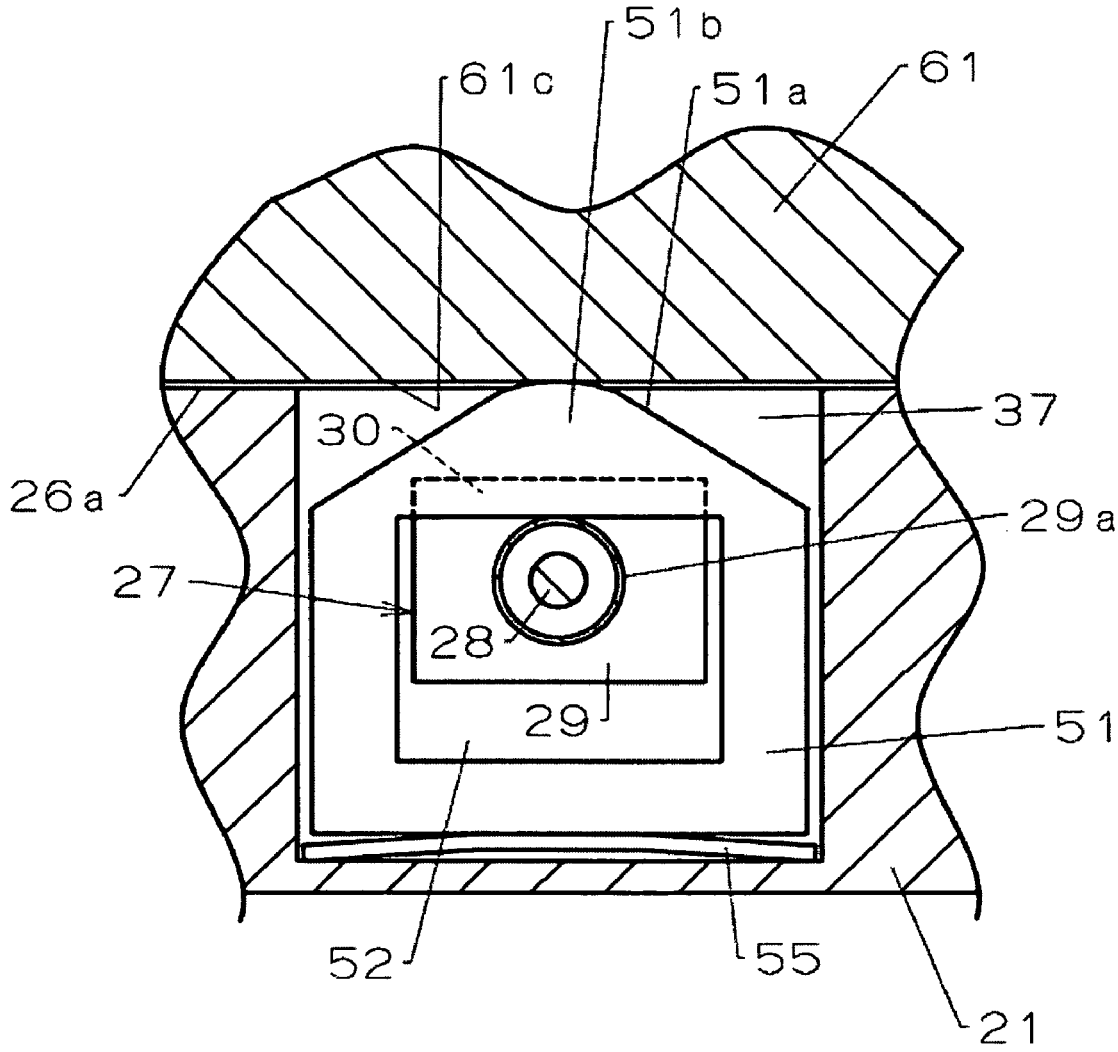
FIG. 4 is a schematic cross-sectional view taken along the line F4-F4 in FIG. 2.

As shown in FIG. 3 and FIG. 4, the push button 27 is formed of a metal or a synthetic resin, and includes a shaft portion 28, an operating head 29, and an engaging portion 30. A distal end (one end) of the shaft portion 28 projecting into the body 21 is configured to push the contact point 16 to move the same by the push button 27 being pushed from the outside of the body (see a double-dashed chain line in FIG. 3).

The cross-section of the shaft portion 28 in the direction orthogonal to the axial direction is a circular shape. The operating head 29 is formed integrally with the other end of the shaft portion 28. The operating head 29 is formed into a shape so as to match the shape of the head insertion hole 35*b*, and has a non-circular shape larger than the shaft portion 28 and, in this embodiment, has a substantially square shape. The engaging portion 30 is formed of a back surface of the operating head 29, for example. Reference numeral 29*a* designates a cylindrical portion projecting integrally from the back surface of the operating head 29 so as to surround the other end portion of the shaft portion 28.

The shaft portion 28 of the push button 27 is inserted into the pipe 41 from the outside of the body, and one end portion of the operating head 29 positioned inside the body 21 is inserted into the head insertion hole 35*b*. In FIG. 2 and FIG. 3, reference numeral 43 designates a water-proof seal ring mounted on the shaft portion 28, and the seal ring 43 is in slidable tight-contact with an inner surface of the pipe 41 in a resiliently deformed state. As shown in FIG. 2 and FIG. 3, a detent member, for example, a stop ring 44 which comes into and out of contact with a distal end of the small-diameter portion of the pipe 41 in association with the axial movement of the push button 27 is mounted at a distal end portion of the shaft portion 28.

A coil spring 45 which is arranged so as to be apart from the back surface of the operating head 29 by the cylindrical portion 29*a* is fitted on the shaft portion 28 and is interposed between the large-diameter portion of the pipe 41 and the back surface of the operating head 29. The coil spring 45 urges the push button 27 in the direction outward of the body, and the stop ring 44 serves to detent the push button 27 from coming apart due to this urge. In a state in which the push button 27 is positioned by the stop ring 44, the other end portion of the operating head 29 located outside of the body 21 projects from the outer surface 21*a* of the body so as to allow the pushing operation. In association with this, the cylindrical portion 29*a* of the operating head 29 penetrates through the storage hole 37, and the distal end of the shaft portion 28 is apart from the contact point 16 in this state.

A locking member 51 for preventing the push button 27 from being accidentally pushed inward of the body 21 when the wristwatch 11 is being carried is stored in the storage hole 37 of the body 21 so as to be movable in the thickness direction of the watch sheath 12 by being guided by the storage hole 37.

The locking member 51 includes an insertion portion 52 formed into a square communication hole at the center thereof. The insertion portion 52 is formed into a shape similar to the shape of the operating head 29 of the push button 27 when viewed from the front or the back and slightly larger than that. The insertion portion 52 may be opened to a peripheral edge of the locking member 51. The operating head 29 is inserted through the insertion portion 52.

Figure 5:
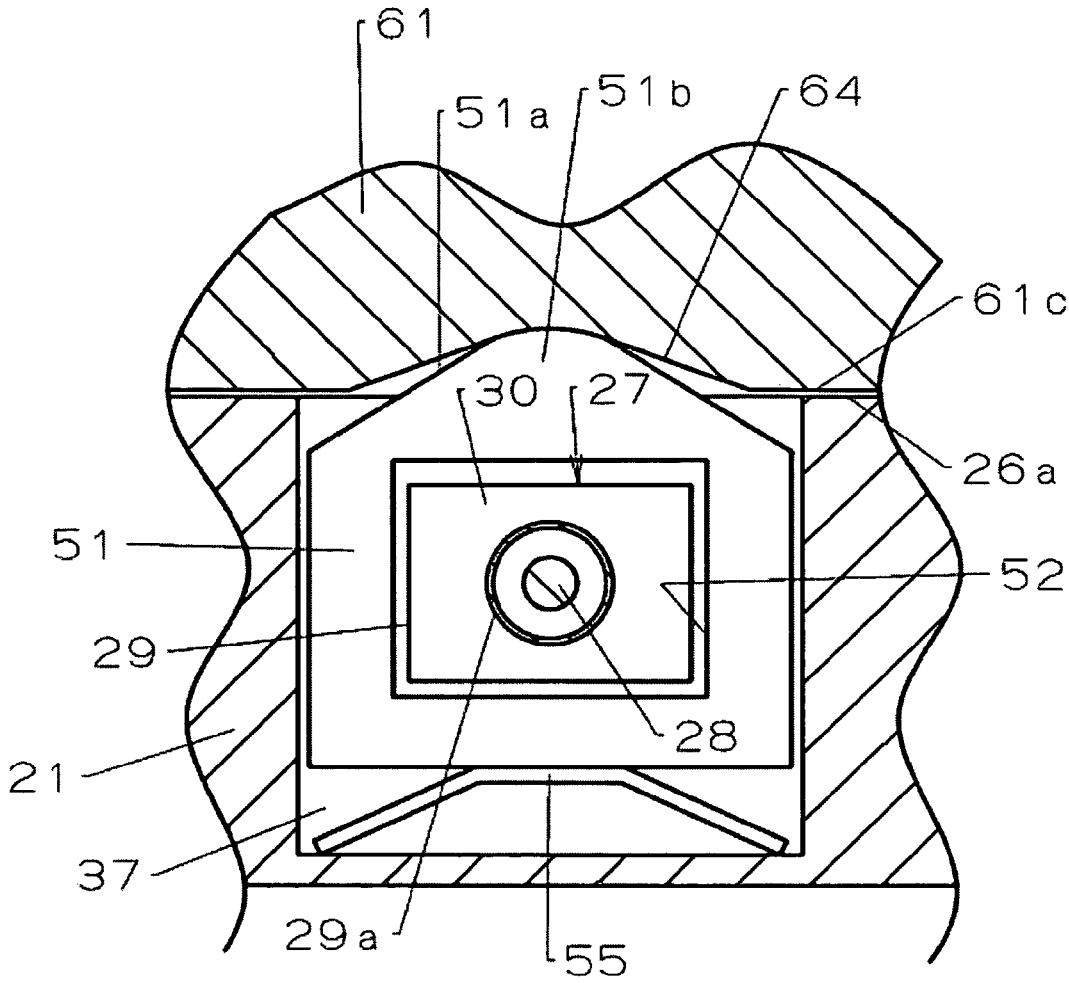
FIG. 5 is a schematic cross-section taken along the line F5-F5 in FIG. 3.

As shown in FIG. 4 and FIG. 5, an edge 51*a* of one end portion (upper end portion) of the locking member 51 is curved substantially into a protruded mountain shape. Therefore, the contour of the locking member 51 has a substantially pentagon shape such as a piece of Japanese Chess as shown in FIG. 4 and FIG. 5. The locking member 51 is slidably stored in the storage hole 37 with the edge 51*a* thereof positioned on the opening end side of the storage hole 37.

A portion between the edge 51*a* of the locking member 51 and the insertion portion 52, that is, the one end portion is used as a stopper portion 51*b*. The engaging portion 30 of the push button 27 is engageable with the stopper portion 51*b*.

An urging member, for example, a leaf spring 55 is stored on the bottom portion of the storage hole 37. The leaf spring 55 is positioned on the opposite side from the stopper portion 51*b* with respect to the insertion portion 52 as a boundary. The locking member 51 is urged by this leaf spring 55 in the direction to be projected from an opening end of the storage hole 37, in other words, toward a back surface of an operating ring 61, described later. The leaf spring 55 may be or may not be connected to the locking member 51.

The circular operating ring 61 is rotatably arranged in the ring arrangement groove 26 of the watch sheath 12. The operating ring 61 is preferably a continuous ring without discontinuity as shown in the drawing, but may have one discontinuity. Reference numeral 21*b* in FIG. 2 and FIG. 3 shows an annular locking projection formed integrally with an outer peripheral surface of the annular projection 25, and an inner peripheral surface of the operating ring 61 is caught by the annular locking projection 21*b*, whereby the operating ring 61 is prevented from coming apart. Therefore, the operating ring 61 is mounted to the body 21 so as to be rotatably fitted to the outer periphery of the annular projection 25 which surrounds the hour plate 14.

A surface (upper surface) and a peripheral surface of the operating ring 61 are exposed. Reference numerals 61*a*, 61*b* in FIG. 1 designate a plurality of finger stop portions formed on the operating ring 61, and the finger stop portions 61*a*, 61*b* are formed of, for example, recesses and are provided on a peripheral portion of the operating ring 61.

A first display 62 and a second display 63 are provided on the exposed surface of the operating ring 61 as shown in FIG. 1. The first display 62 and the second display 63 are provided so as to correspond to the radial direction of the operating ring 61, and the first display 62 is a character string of "LOCK", and the second display 63 is a character string of "UNLOCK". The first display 62 and the second display 63 are configured to align with, for example, the winder 81 as a mark, but the mark may be provided on the body 21 irrespective of the winder 81.

Figure 8:
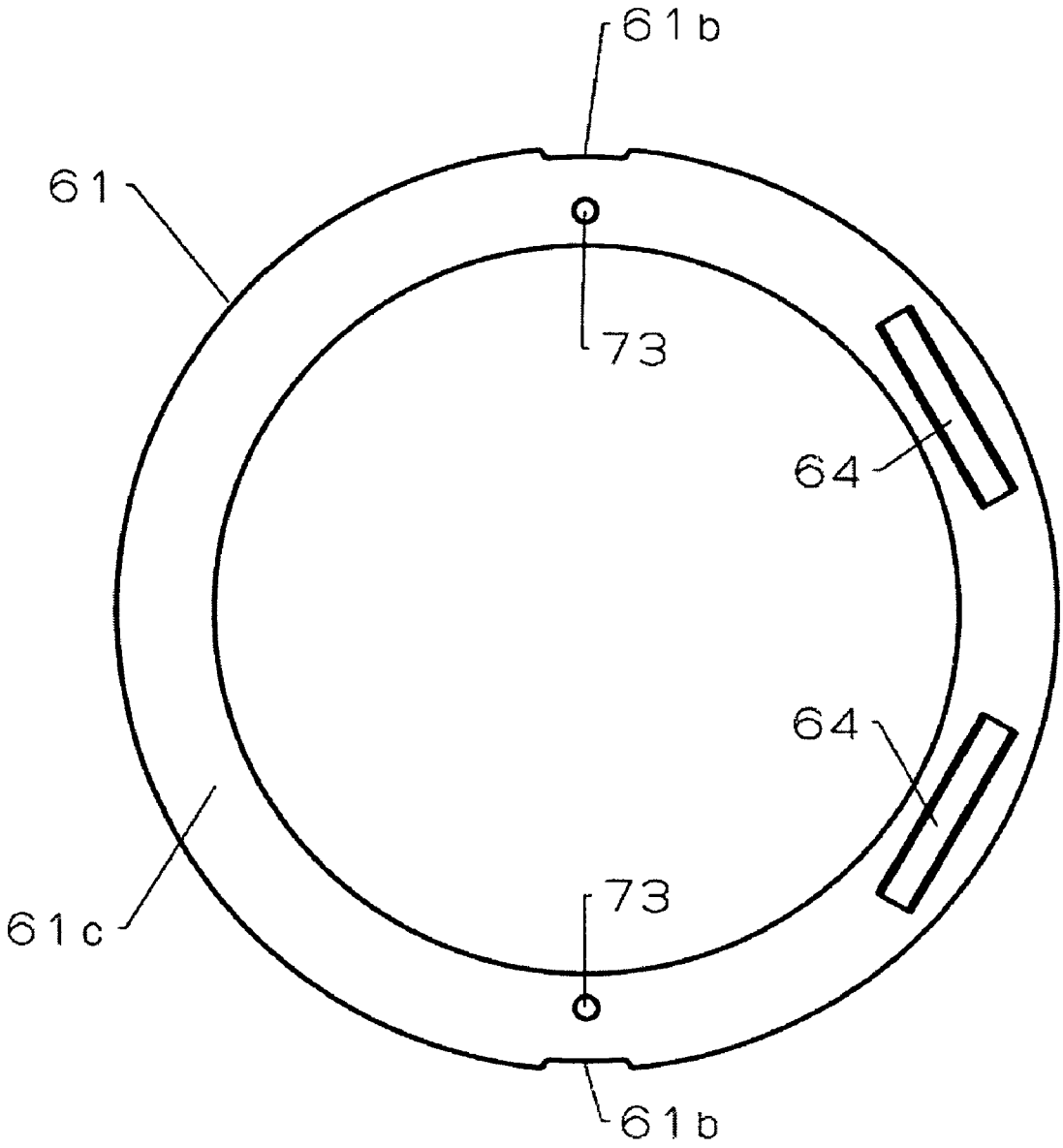
FIG. 8 is a back surface view of the operating ring of the wristwatch in FIG. 1.

As shown in FIG. 8, the operating ring 61 includes a lock surface 61*c* and unlocking recesses 64. The lock surface 61*c* is formed on the back surface of the operating ring 61, which comes into contact with the bottom surface 26*a* of the ring arrangement groove 26. The unlocking recesses 64 are provided by the same number as the push buttons 27 so as to open to the lock surface 61*c*. The edge 51*a* of the locking member 51 is pressed against the lock surface 61*c*, and the stopper portion 51*b* of the locking member 51 can be inserted into and removed from the unlocking recess 64.

When the lock surface 61*c* of the operating ring 61 is opposed to an opening end of the storage hole 37, the locking member 51 is pressed downward against the leaf spring 55 by the lock surface 61*c* closing the opening end as shown in FIG. 2 and FIG. 4, and hence the stopper portion 51*b* of the locking member 51 is held in a state of opposing the engaging portion 30 of the push button 27 from the inside of the body 21 in the proximity thereto.

When the unlocking recess 64 of the operating ring 61 is opposed to the opening end of the storage hole 37 and is continued to the storage hole 37, the locking member 51 is moved upward by the urging force of the leaf spring 55, and the stopper portion 51*b* is inserted into the unlocking recess 64 as shown in FIG. 3 and FIG. 5, so that the stopper portion 51*b* is held above the engaging portion 30 of the push button 27 in a state of being apart therefrom.

The locking member 51, the leaf spring 55, and the operating ring 61 constitute locking means configured to position the push button 27 having the engaging portion 30 at a predetermined position and hold the same in the locked state when not in use, and be able to release this locked state when the push button 27 is to be operated.

Figure 7:
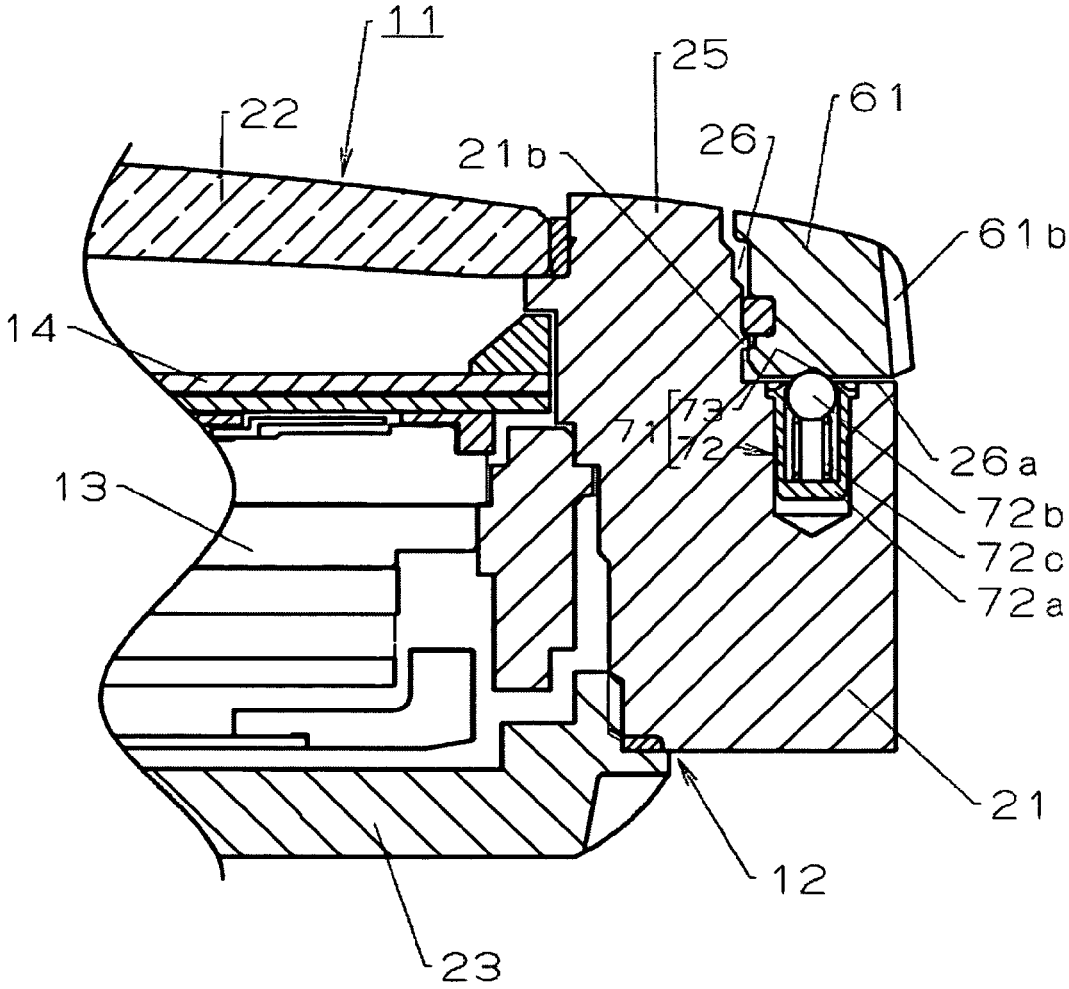
FIG. 7 is a cross-sectional view showing a portion around a click-stop mechanism of the wristwatch in FIG. 1.

The wristwatch 11 includes, for example, a pair of click-stop mechanisms 71 shown in FIG. 7. The click-stop mechanisms 71 each include a mechanism portion 72 and a stop recess 73.

As shown in FIG. 6, the mechanism portions 72 are mounted on the body 21, for example, on a line passing through 12 o'clock and 6 o'clock. The mechanism portions 72 each includes a cylindrical holder 72*a* embedded in the body 21, a rotatable steel ball 72*b* supported by the holder 72*a* so as to be movable in the vertical direction and not to come apart upward, and a spring 72*c* stored in the holder 72*a* and configured to urge the steel ball 72*b* upward as shown in FIG. 7. Upper portions of the steel balls 72*b* project from the bottom surface 26*a* of the ring arrangement groove 26.

The stop recesses 73 are formed on the operating ring 61 by 180° apart from each other so as to open on the lock surface 61*c* which constitutes the back surface of the operating ring 61 as shown in FIG. 8. The steel balls 72*b* are disengageably engageable with the stop recesses 73.

In a state in which the operating ring 61 is rotated so that the first display 62 is aligned with the winder 81, the steel ball 72*b* engages the stop recess 73 and hence the operating ring 61 is temporarily held and, in this temporarily held state, the locking member 51 is pressed downward by the lock surface 61*c* of the operating ring 61, and is arranged at the locked position. Also, in a state in which the operating ring 61 is rotated so that the second display 63 is aligned with the winder 81, the stop recess 73 is disengaged from the steel ball 72*b*, and the locking member 51 is pushed upward in this state to engage the unlocking recess 64, and is arranged at the unlocked position.

In a state in which the push buttons 27 of the wristwatch 11 configured as described above are not used such as when being carried, the locking members 51 are arranged at the locked positions as shown in FIG. 2 and FIG. 4 in order to prevent the push buttons 27 from being pressed accidentally inward of the body 21. This locked state is achieved by rotating the operating ring 61 and aligning the first display 62 on the surface thereof with the winder 81.

When the locking member 51 is adequately arranged at the locked position by the rotation of the operating ring 61, at this moment, the click-stop mechanism 71 performs a click-stop action to temporarily hold the operating ring 61. In this case, the user is notified that the locking member 51 is placed at the locked position by the feeling of detent provided by the click-stop operation and the sounds generated in association with the detent.

In the locked state, since the lock surface 61*c* of the operating ring 61 is in contact with the edge 51*a* of the locking member 51, the locking member 51 is pushed downward against the urging force of the leaf spring 55, and is arranged in the locked position shown in FIG. 2 and FIG. 4.

The engaging portions 30 of the push button 27 opposes the stopper portion 51*b* of the locking member 51 arranged at the locked position at close range from the outside of the body 21. Therefore, when a pushing force acts accidentally on the push button 27 in the locked state by an impact applied when the wristwatch 11 falls, the engaging portion 30 of the push button 27 is caught by the stopper portion 51*b* of the locking member 51 immediately. The push button 27 is restrained from moving from the predetermined position by such engagement and an erroneous operation such that the push button 27 is accidentally pressed inward is prevented.

In this case, in addition to the fact that the locking member 51 has no risk of being deformed because it is formed of metal and hence has a high strength by itself, since it is formed into a plate shape having a wide area, an erroneous pushing force with respect to the locking member 51 can be supported by the inner surface of the storage hole 37 of the body 21 which guides the movement of the locking member 51 over a large surface. Therefore, the prevention of the erroneous operation is highly reliable.

In addition, since the mutual engagement of the threads as in the related art is not necessary, a load directed outward is not applied on the push button 27 when the locking member 51 is arranged at the locked position. In addition, since the load directed outward of the body with respect to the push button 27 is not gradually increased even by increase in the number of times of rotation of the operating ring 61, security is ensured. Also, in the configuration in which the mutual engagement of the threads as in the related art is utilized, if the locking member is excessively rotated when the locking member is moved to the locked position, the push button might come apart outward of the body. Also, since the mutual engagement of the threads as in the related art is not necessary, it is easy to machine. In other words, since the locking member 51 can easily be obtained by punching by a press work, and the machining of the operating ring 61 is also easy, good manufacturability is achieved.

When it is necessary to operate the push button 27, first of all, the operating ring 61 is rotated by 180° from the state shown in FIG. 2 and in FIG. 4 and the second display 63 is aligned with the winder 81 to move the locking member 51 to the unlocked position, then the pushing operation of the push button 27 is performed.

By the rotation of the operating ring 61, the lock surface 61*c* is released from the locking member 51, and the unlocking recess 64 of the operating ring 61 opposes the locking member 51. Therefore, the locking members 51 are pushed upward by the urging force of the leaf springs 55 and enter the unlocking recesses 64, and are arranged in the unlocked position. In association with this, the stopper portions 51*b* of the locking members 51 are released upward so as not to oppose the engaging portions 30 of the push buttons 27, whereby a state of allowing the pushing operation of the push button 27 is assumed.

In this case as well, the locking members 51 enter the unlocking recesses 64 by the urging force of the leaf springs 55, and the click-stop action similar to that of the click-stop mechanism 71 is achieved. Therefore, the user is notified that the locking members 51 are placed at the unlocked positions by the feeling of detent provided by this operation and the sounds generated in association with the detent.

By pushing the push button 27 inserted into the insertion portion 52 of the locking member 51 in the unlocked state as described above, the push button 27 can be moved inward of the body 21 from the predetermined position shown in FIG. 2 and by a solid line in FIG. 3. Accordingly, the contact point 16 is pressed by the push button 27, and a predetermined function provided to the contact point 16 can be performed.

The circular operating ring 61 rotatably mounted on the watch sheath 12 as described above functions as a cam, and the locking members 51 pressed against the cam surface (the lock surface 61*c* and the unlocking recesses 64 continued therefrom) by the leaf springs 55 follow. Therefore, by rotating the operating ring 61 from the front side of the watch sheath 12, the locking members 51 urged toward the operating ring 61 with the leaf springs 55 can be arranged in the locked position or the unlocked position in conjunction therewith.

Since the operating ring 61 surrounds the hour plate 14 mounted on the watch sheath 12, it is much larger than the push button 27 which is pressed from the side of the body 21. Therefore, the operating ring 61 can easily be rotated by gripping the same. In addition, since the operating ring 61 is operated from the front side of the watch sheath 12, even though the wristwatch 11 is worn on the wrist of the user, the operation is rarely hindered by the wrist.

Therefore, the operation to restrain the push button 27 from being moved accidentally when not in use and the operation to release this restraint are easily achieved.

In addition, since the first embodiment is configured to hinder the pushing operation of the push button 27 using the locking member 51 arranged at the locked position, the operating ring 61 interlocked with the locking member 51 and the push button 27 are arranged at separate positions, so that the push button 27 does not constrain the rotation of the operating ring 61. Therefore, the pushbutton 27 can be formed into a square shape in front view as exemplified in the first embodiment. The shape of the push button 27 in front view can be a circular shape and, instead, it may be formed into arbitrary non-circular shapes other than the square shape. Therefore, it is preferable in that the flexibility in design of the wristwatch 11 can be enhanced.

Figure 9:
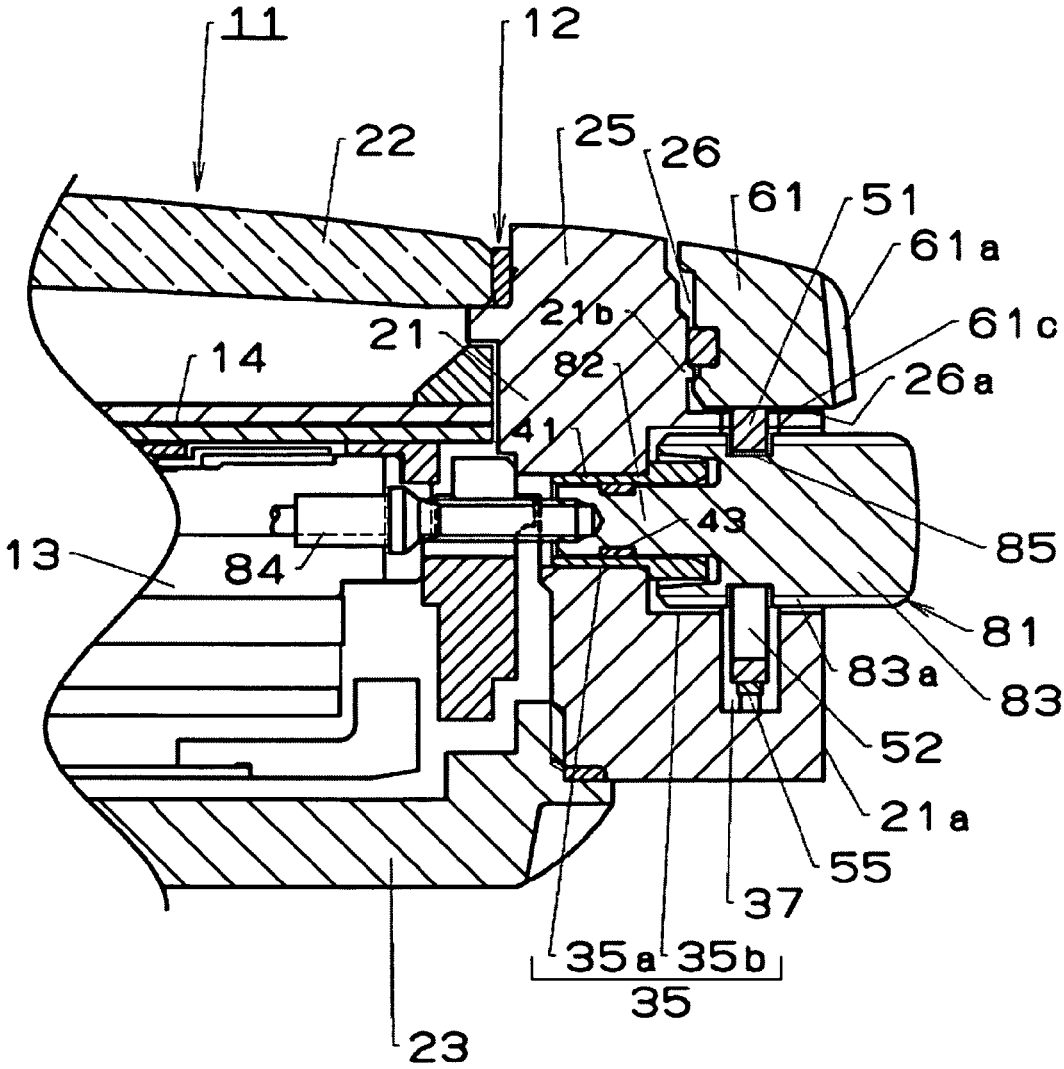
FIG. 9 is a cross-sectional view of a winder mounting portion of the wristwatch according to a second embodiment of the present invention in a state in which a winder is locked.
Figure 10:
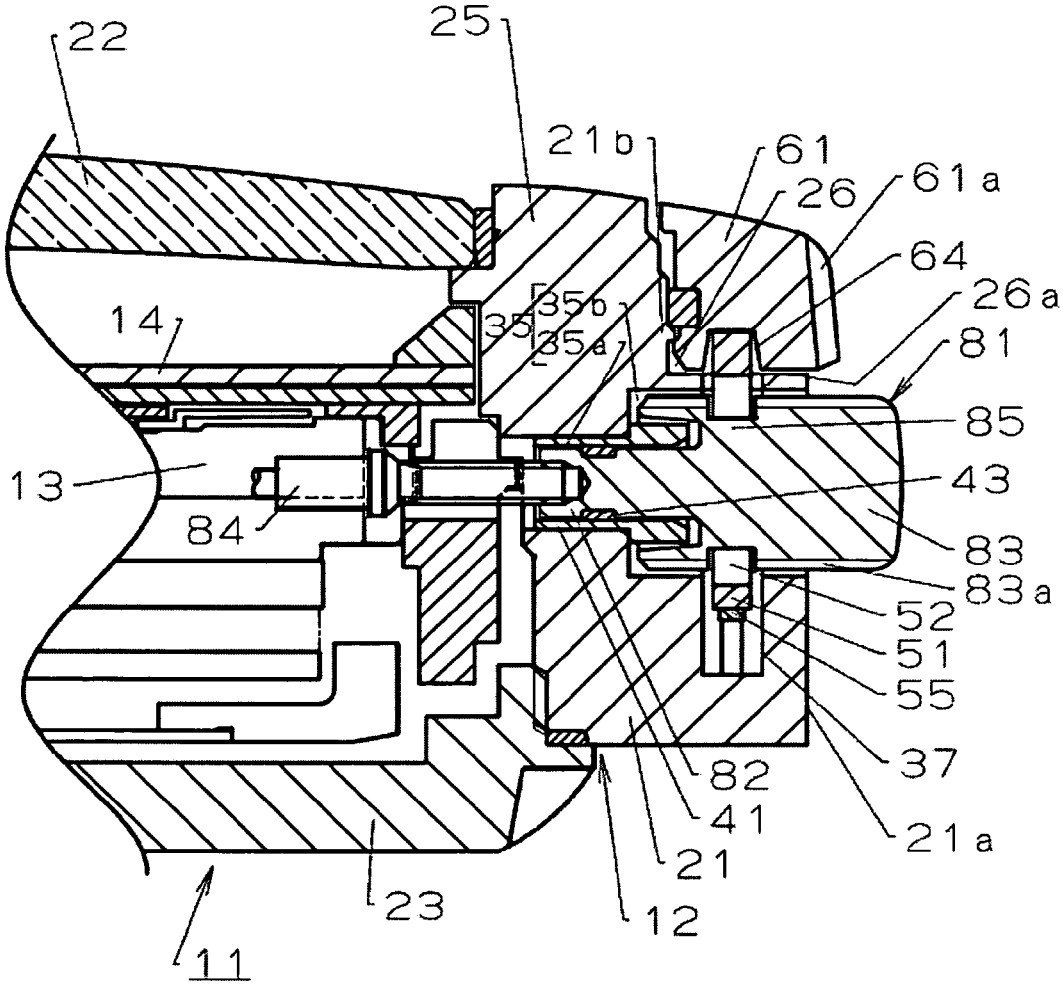
FIG. 10 is a cross-sectional view showing the winder mounting portion of the wristwatch according to the second embodiment in a state in which the lock of the winder is released.

FIG. 9 and FIG. 10 show a second embodiment of the present invention. Since this embodiment is the same as the first embodiment other than those described below, the same components as the first embodiment are designated by the same reference numerals and the description will be omitted. The second embodiment is different from the first embodiment in that the winder 81 as the push-pull operating member is restrained so as not to move from the predetermined position by the locking means when not in use, and the restraint is releasable when the winder 81 is operated.

More specifically, the winder 81 includes a shaft portion 82 and an operating head 83 integrally continued therefrom, and the shaft portion 82 is connected to the watch movement 13 via a setting stem 84 connected thereto.

The operating head 83 is larger in diameter than the shaft portion 82, and a serration 83*a* for reducing probability of slip of fingers of the user who holds the operating head 83 to rotate the same is formed on the outer periphery thereof by spline machining. In addition, an engaging portion 85 formed into an annular recess is formed on the outer periphery of the operating head 83 so as to extend across the serration 83*a*. The configurations other than those described above are the same as in the first embodiment including the configurations which is not shown in FIG. 9 and FIG. 10.

In the wristwatch 11 according to the second embodiment, in a state in which the winder 81 is not used such as the case of being carried, the locking member 51 is arranged at the locked position in which the unintended pulling of the winder 81 outward and sideward of the body 21 is prevented as shown in FIG. 9.

In a state in which the winder 81 is locked by the locking means, the lock surface 61*c* of the operating ring 61 is in contact with the edge 51*a* (see FIG. 4 and FIG. 5) of the locking member 51, and hence the locking member 51 is pushed downward against the urging force of the leaf spring 55 and is arranged in the locked position shown in FIG. 9. The stopper portion 51*b* (see FIG. 4 and FIG. 5) of the lock member 51 arranged at this locked position is fitted into the engaging portion 85 which is a recess formed on the winder 81.

Therefore, when a pulling force acts accidentally on the winder 81 in the locked state, the stopper portion 51*b* of the lock member 51 is caught by a wall surface of the recess which forms the engaging portion 85 immediately from the inner side of the body 21. With such engagement, the winder 81 is restrained from moving from the predetermined position, and the erroneous operation that the winder 81 is accidentally pulled out is prevented.

When it is necessary to operate the winder 81, first of all, the operating ring 61 is rotated by 180° from the state shown in FIG. 9 and the second display 63 (see FIG. 1) is aligned with the winder 81 to move the locking member 51 to the unlocked position, then the winder 81 is pulled out and the rotating operation is performed.

By the rotation of the operating ring 61, the lock surface 61*c* is released from of the locking member 51, and the unlocking recess 64 of the operating ring 61 opposes the locking member 51. Therefore, the locking members 51 are pushed upward by the urging force of the leaf springs 55 and enter the unlocking recesses 64, and are arranged in the unlocked position (see FIG. 10). In association with this, the stopper portion 51*b* of the locking member 51 is released and moved upward of the engaging portion 85 of the winder 81, and the state of allowing the pulling operation of the winder 81 is achieved.

Therefore, the winder 81 inserted into the insertion portion of the locking member 51 can be pulled out from the predetermined position shown in FIG. 9 and FIG. 10 in the axial direction in this unlocked state, so that the winder 81 can be rotated to adjust the time of the day or the date.

Since other actions are the same as those in the first embodiment, the description will be omitted. Therefore, according to the second embodiment as well, the problem of the present invention can be solved.

The present invention is not limited to the respective embodiments as described above, and may be applied to portable devices such as stop watches, mobile phones, portable information terminal in addition to the portable watches.

What is claimed is:

1. A portable device comprising: an operating member having an engaging portion and being slidably mounted on a device sheath; a locking member movable between a locked position in which the operating member is restrained at a predetermined position by engagement of the locking member with the engaging portion and an unlocked position in which a sliding operation of the operating member is allowed; an urging member configured to urge the locking member toward the unlocked position, the locking member and the urging member being arranged on the device sheath; and a circular operating ring surrounding a display portion mounted on the device sheath and being mounted on the device sheath from the front side thereof so as to allow a rotating operation of the operating ring relative to the locking member, wherein the movement of the locking member from the locked position to the unlocked position is interlocked with the rotating operation of the operating ring.

2. A portable device according to claim 1; wherein the operating member is a push button, and a pushing operation of the push button is prevented by the locking member arranged at the locked position.

3. A portable device according to claim 2;

wherein the shape of the operating head of the push button in front view is a non-circular shape.

4. A portable device according to claim 1;

further comprising a click-stop mechanism configured to temporarily hold the operating ring in a state in which the locking member is arranged at the locked position.

5. A portable watch configured with the portable device according to claim 1.

6. A portable watch configured with the portable device according to claim 1; wherein a push-pull winder of the portable watch constitutes the operating member, and a pulling operation of the winder is prevented by the locking member arranged at the locked position.

7. A portable device comprising:

a device sheath having a through-hole and a storage hole intersecting the through-hole;

a display portion mounted on the device sheath;

a pipe inserted into the through-hole and fixed to the device sheath;

an operating member having a shaft portion slidably inserted into the pipe, an operating head provided at one end of the shaft portion and inserted into the through-hole, and an engaging portion formed on the operating head;

a circular operating ring surrounding the display portion and having a locking surface which can oppose the storage hole and an unlocking recess opening on the locking surface and being rotatably mounted on the device sheath from the front side of the sheath;

a locking member having an insertion portion into which the operating head can be inserted and a stopper portion which allows engagement of the engaging portion, the locking member being stored in the storage hole so as to be movable between a locked position where the engaging portion is engaged with the stopper portion and an unlocked position where the stopper portion is positioned apart from the engaging portion; and an urging member arranged in the storage hole and urging the locking member toward the operating ring.

8. A portable device according to claim 7; wherein the operating member is a push button, and a pushing operation of the push button is prevented by the locking member arranged at the locked position.

9. A portable device according to claim 8;

wherein the shape of the operating head of the push button in front view is a non-circular shape.

* * * * *